US009299306B2

(12) United States Patent
Ye et al.

(10) Patent No.: US 9,299,306 B2
(45) Date of Patent: Mar. 29, 2016

(54) LIQUID CRYSTAL DISPLAY DEVICE

(71) Applicants: Shanghai AVIC Optoelectronics Co., Ltd., Shanghai (CN); Tianma Micro-Electronics Co., Ltd., Shenzhen (CN)

(72) Inventors: Song Ye, Shanghai (CN); Xupeng Wang, Shanghai (CN); Xiaoyuan Ding, Shanghai (CN); Zhengyuan Huang, Shanghai (CN); Wenjing Li, Shanghai (CN); Xu Yang, Shanghai (CN)

(73) Assignees: Shanghai AVIC OPTO Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 153 days.

(21) Appl. No.: 14/219,949

(22) Filed: Mar. 19, 2014

(65) Prior Publication Data

US 2015/0138057 A1 May 21, 2015

(30) Foreign Application Priority Data

Nov. 20, 2013 (CN) ..... 2013 1 0589623

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 3/36* (2013.01); *G09G 2300/0408* (2013.01); *G09G 2300/0417* (2013.01); *G09G 2300/0819* (2013.01); *G09G 2300/0871* (2013.01); *G09G 2320/0693* (2013.01); *G09G 2320/08* (2013.01)

(58) Field of Classification Search
None
See application file for complete search history.

(56) References Cited

U.S. PATENT DOCUMENTS

2009/0021509 A1* 1/2009 Lee ..... G09G 3/3677 345/213
2014/0104248 A1* 4/2014 Won ..... G09G 5/00 345/204

FOREIGN PATENT DOCUMENTS

CN 101359440 A 2/2009
CN 101598859 A 12/2009
CN 101620832 A 1/2010

OTHER PUBLICATIONS

Office Action in corresponding Chinese Application 201310589623.2, dated Aug. 17, 2015.

* cited by examiner

*Primary Examiner* — Joseph Haley
*Assistant Examiner* — Ifedayo Iluyomade
(74) *Attorney, Agent, or Firm* — Alston & Bird LLP

(57) ABSTRACT

A liquid crystal display device is disclosed. The display device includes gate drive ASG circuits, and a driver integrated circuit configured to connect wires from gate line output terminals of the ASG circuits with a client system. The ASG circuits output level signals to the client system, and the client system is configured to determine a duration time during which the level signals from the ASG circuits exceed a preset level signal threshold value, and in response to the duration time being less than the preset time threshold value, the driver integrated circuit receives an adjusted signal code required for operation of the ASG circuits, and the driver integrated circuit drives the ASG circuits according to the adjusted signal code required for operation of the ASG circuits.

11 Claims, 4 Drawing Sheets

-- Prior Art --

LIQUID CRYSTAL DISPLAY DEVICE

CROSS-REFERENCES TO RELATED APPLICATIONS

This application claims the benefit of priority to Chinese Patent Application No. 201310589623.2, filed with the Chinese Patent Office on Nov. 20, 2013 and entitled "LIQUID CRYSTAL DISPLAY DEVICE", the content of which is incorporated herein by reference in its entirety.

FIELD OF THE INVENTION

The invention relates to the technical field of displays, and in particular to a liquid crystal display device.

BACKGROUND OF THE INVENTION

As shown in FIG. 1, a liquid crystal display device in the prior art comprises: a liquid crystal display module 10, Amorphous Silicon Gate (ASG) driver circuits 11, a Driver Integrated Circuit (Driver IC) 12, a Flexible Printed Circuit (FPC) 13 and a client system 14. The client system sends an initialization code to the Driver IC, wherein the initialization code comprises signals and timing required when the ASG circuits operate, such as a positive-phase clock signal CK, a reverse-phase clock signal CKB, a reset signal Reset and the like. The Driver IC outputs the signals and timing required when the ASG circuits operate according to the received initialization code, and then the ASG circuits output gate switching signals required by Thin Film Transistor (TFT) devices.

When the liquid crystal display device in the prior art leaves the factory, the initialization code has already been set, and the initialization code has fixed values. However, in the actual production and working processes, the liquid crystal display device is influenced by the environment temperature and production process conditions such as fluctuation, and the ASG circuits may suffer from output anomalies or no output, wherein the output anomalies of the ASG circuits include: one group of signals CK or CKB in the ASG circuits are not outputted, or as shown in FIG. 1, the outputs of the ASG circuits at the left side and the right side in the liquid crystal display module are asymmetric, for example, in the actual production process, the influence of TFT process conditions such as fluctuation exists, so that characteristics of the ASG circuits at the both sides are asymmetric. When TFTs located at the left side of the liquid crystal display module are influenced by the fluctuation, and TFTs located at the right side of the liquid crystal display module are not influenced by the fluctuation in the actual production process, the outputs of the ASG circuits located at the left side and the right side in the liquid crystal display module are asymmetric at the moment.

To sum up, the liquid crystal display device in the prior art has display anomalies, for example, a common low-temperature white screen, horizontal stripes and the like, and the ASG circuits have poor reliability.

BRIEF SUMMARY OF THE INVENTION

One inventive aspect is a liquid crystal display device. The display device includes gate drive ASG circuits, and a driver integrated circuit configured to connect wires from gate line output terminals of the ASG circuits with a client system. The ASG circuits output level signals to the client system, and the client system is configured to determine a duration time during which the level signals from the ASG circuits exceed a preset level signal threshold value, and in response to the duration time being less than the preset time threshold value, the driver integrated circuit receives an adjusted signal code required for operation of the ASG circuits, and the driver integrated circuit drives the ASG circuits according to the adjusted signal code required for operation of the ASG circuits.

DETAILED DESCRIPTION OF THE INVENTION

An embodiment of the present invention provides a liquid crystal display device, to increase the reliability of ASG circuits, and improve and solve the problem of bad display of the liquid crystal display device caused by output anomalies or no output of the ASG circuits.

A technical solution according to the embodiment of the present invention will be described below in details.

Figure 1:
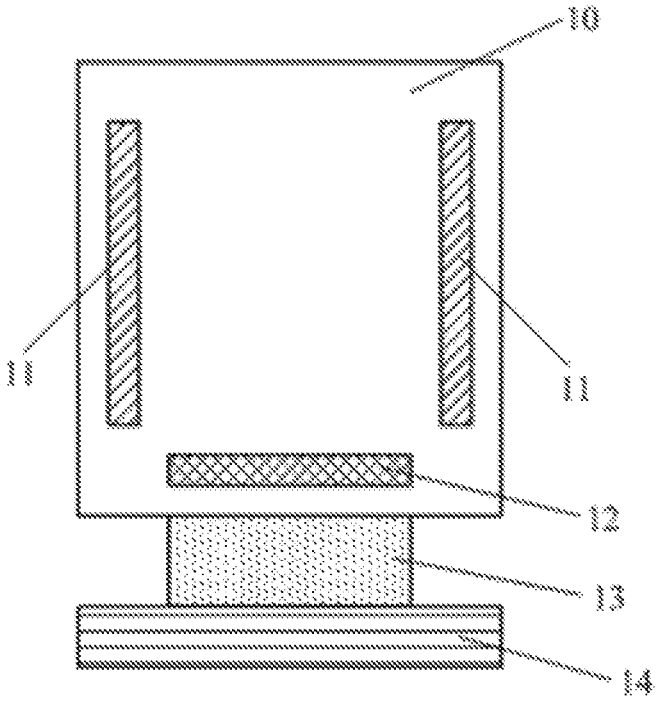
FIG. 1 is a structural schematic diagram of a liquid crystal display device in the prior art.
Figure 2:
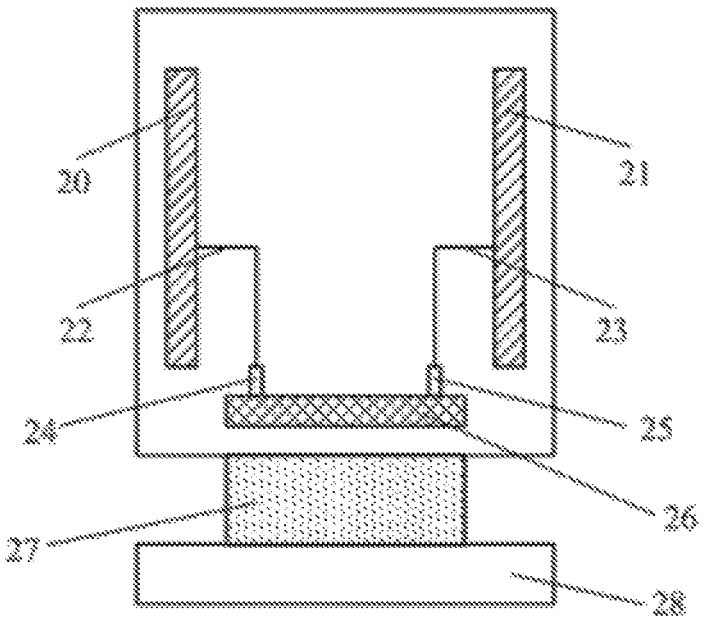
FIG. 2 is a structural schematic diagram of a liquid crystal display device according to an embodiment of the present invention.

As shown in FIG. 2, the embodiment of the present invention provides a liquid crystal display device, comprising gate drive ASG circuits 20 and 21, a driver integrated circuit 26 and a client system 28. In the actual production process, the influence of TFT process conditions such as fluctuation exists, so that characteristics of the ASG circuits at both sides are asymmetric, for example, the problems of horizontal stripes and the like may occur, and in order to avoid the occurrence of such problems, generally wires are led out from gate line output terminals of the ASG circuits at the left side and the right side respectively for feedback.

For example: the wire led out from the gate line output terminal 22 of the left ASG circuit 20 is connected with the driver integrated circuit 26 via a pin 24 added to the driver integrated circuit 26; the wire led out from the gate line output terminal 23 of the right ASG circuit 21 is connected with the driver integrated circuit 26 via a pin 25 added to the driver integrated circuit 26; and then an FPC 27 is bonded for feedback to the client system 28.

The client system 28 receives level signals outputted by the gate line output terminals of the ASG circuits, determines the duration time in which the level signals outputted by the gate line output terminals of the ASG circuits exceed a preset level signal threshold value, and adjusts a signal code required for operation of the ASG circuits and then sends the adjusted signal code to the driver integrated circuit 26 when the duration time is less than a preset time threshold value, and the driver integrated circuit 26 drives the ASG circuits according to the adjusted signal code required for operation of the ASG circuits.

Preferably, the client system receives the level signals outputted by the gate line output terminals of the ASG circuits, determines the duration time in which the level signals outputted by the gate line output terminals of the ASG circuits exceed the preset level signal threshold value, and adjusts the signal code required for operation of the ASG circuits and then sends the adjusted signal code to the driver integrated circuit when the duration time is less than the preset time threshold value specifically as follows: the client system compares the duration time in which the level signals outputted by the ASG circuits exceed the preset level signal threshold value with the preset time threshold value, and when the time is less than the preset time threshold value, the client system adjusts the duty cycles of clock signals CK and CKB, where the clock signals CK and CKB belong to the signal code required for operation of the ASG circuits, or adjusts values of a highest voltage VGH and a lowest voltage VGL, where the highest voltage VGH and the lowest voltage VGL belong to the signal code required for operation of the ASG circuits, and the client system sends the adjusted signal code required for operation of the ASG circuits to the driver integrated circuit, so that the time in which the level signals outputted by the ASG circuits exceed the preset level signal threshold value is greater than or equal to the preset time threshold value.

Figure 3A:
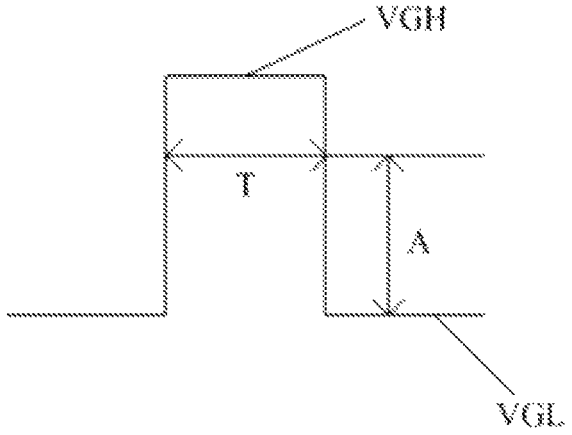
FIG. 3(*a*) and FIG. 3(*b*) are schematic diagrams of time width variation of a working voltage of a liquid crystal display device according to an embodiment of the present invention.
Figure 3B:
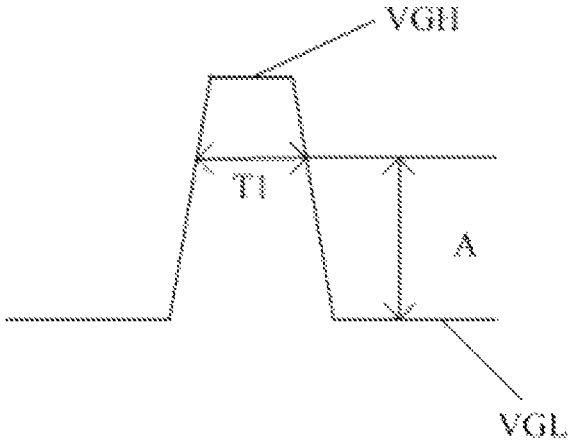

Specifically, as shown in FIG. 3(*a*) and FIG. 3(*b*), the client system is specifically configured to: compare the duration time in which the level signals outputted by the ASG circuits exceed the preset level signal threshold value with the preset time threshold value. As shown in FIG. 3(*a*), a time width corresponding to the preset time threshold value is T. When the characteristics of TFTs are changed along with the environment, the rising edge time is increased, and at the moment, the effective charging time width of the TFT switch is reduced, that is, a time width T1 corresponding to the duration time in which the level signals outputted by the ASG circuits exceed the preset level signal threshold value is reduced, as shown in FIG. 3(*b*). When the time width T1 corresponding to the duration time is less than the time width T corresponding to the preset time threshold value, the client system is configured to adjust the duty cycles of the clock signals CK and CKB, where the clock signals CK and CKB belong to the signal code required for operation of the ASG circuits, or to adjust the values of the highest voltage VGH and the lowest voltage VGL, where the highest voltage VGH and the lowest voltage VGL belong to the signal code required for operation of the ASG circuits, wherein a voltage value A in the FIG. 3(*a*) and FIG. 3(*b*) represents the minimum voltage difference between VGH and VGL when the ASG circuits can operate normally; and the client system is configured to send the adjusted signal code required for operation of the ASG circuits to the driver integrated circuit, so that the time in which the level signals outputted by the ASG circuits exceed the preset level signal threshold value is greater than or equal to the preset time threshold value. For example, in a specific embodiment of the present invention, when the duty cycles of CK and CKB or the values of the highest voltage VGH and the lowest voltage VGL are adjusted, the different duty cycles (such as 35%-48%) of CK/CKB and 20 different voltage combinations of VGH/VGL are pre-stored in the system, and the arrangement in accordance with corresponding power consumptions from low to high is as follows: code 1, code 2, . . . , and code 20, wherein in the same conditions, the greater the duty cycle of CK/CKB is, the higher the corresponding power consumption is; and the greater the absolute value of VGH/VGL is, the higher the corresponding power consumption is. The time width corresponding to the preset time threshold value is T, and the duty cycle time can be adjusted by 30%-45% in a combinational manner; a signal code with the lowest power consumption and ensuring that the ASG circuits operate normally in the current situation is obtained through program judgment and selection, and the code is sent to the driver integrated circuit, so that the time in which the level signals outputted by the ASG circuits exceed the preset level signal threshold value is greater than or equal to the preset time threshold value. In this way, the signal code required for operation of the ASG circuits can be conveniently adjusted by adjusting the duty cycles of the clock signals CK and CKB, where the clock signals CK and CKB belong to the signal code required for operation of the ASG circuits, or by adjusting the values of the highest voltage VGH and the lowest voltage VGL, where the highest voltage VGH and the lowest voltage VGL belong to the signal code required for operation of the ASG circuits, thus increasing the reliability of the ASG circuits.

Preferably, the client system comprises: a level conversion module and a master chip I/O port logical control unit, wherein:

the level conversion module is configured to receive and reduce the level signals outputted by the ASG circuits, and to input the reduced level signals to the master chip I/O port logical control unit; and the master chip I/O port logical control unit is configured to receive the reduced level signals, to determine the duration time in which the level signals outputted by the gate line output terminals of the ASG circuits exceed the preset level signal threshold value, and to adjust the signal code required for operation of the ASG circuits and then to send the adjusted signal code to the driver integrated circuit when the duration time is less than the preset time threshold value.

Figure 4:
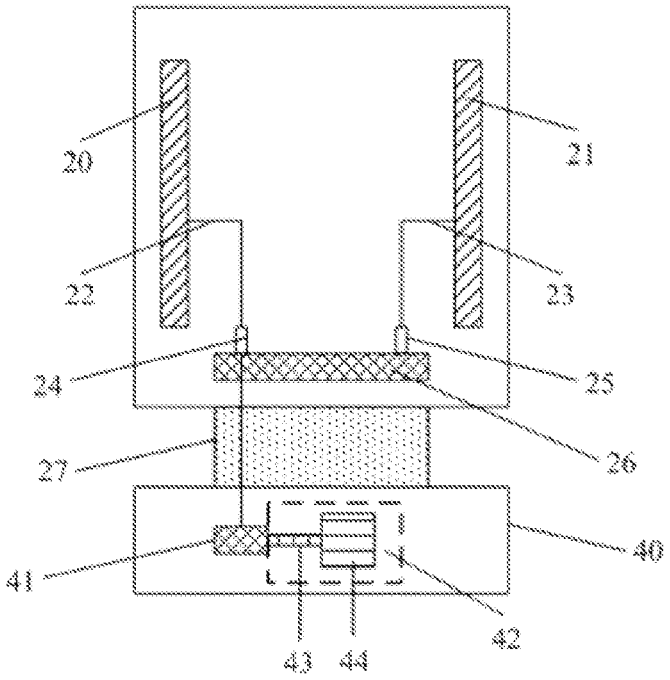
FIGS. 4-6 are schematic diagrams of a specific structure inside a client system in a liquid crystal display device according to an embodiment of the present invention.

Specifically, as shown in FIG. 4, the client system 40 comprises: a level conversion module 41 and a master chip I/O port logical control unit 42, wherein the master chip I/O port logical control unit 42 comprises a master chip I/O port 43 and a system master chip 44; wherein the system master chip 44 is provided with a Digital Signal Processor (DSP) chip or an ARM processor chip of at least one mobile phone operation system of Symbian, Research In Motion, iPhone OS, Android, Microsoft Windows Phone, Linux and the like for data processing and data control;

the level conversion module 41 is configured to receive and reduce the level signals outputted by the ASG circuit 20, and to input the reduced level signals to the master chip I/O port logical control unit 42; and the master chip I/O port logical control unit 42 is configured to receive the reduced level signals, to determine the duration time in which the level signals outputted by the gate line output terminals of the ASG circuits exceed the preset level signal threshold value, and to adjust the signal code required for operation of the ASG circuits and then to send the adjusted signal code to the driver integrated circuit 26 when the duration time is less than the preset time threshold value.

In this way, through the level conversion module, the level signals outputted by the gate line output terminals of the ASG circuits can be converted to level signals with lower power consumption and then the level signals with lower power consumption are inputted to the master chip I/O port logical control unit, so as to reduce the loss of power consumption; and the master chip I/O port logical control unit is configured to perform data processing judgment, so as to detect and adjust the signal code in real time, thus increasing the reliability of the ASG circuits.

Preferably, the gate line output terminals of the ASG circuits include a gate line output terminal of a first ASG circuit and a gate line output terminal of a second ASG circuit, wherein the gate line output terminal of the first ASG circuit is the gate line output terminal of the ASG circuit at the leftmost side in the device, and the gate line output terminal of the second ASG circuit is the gate line output terminal of the ASG circuit at the rightmost side in the device.

Specifically, as shown in FIG. 4, the gate line output terminals of the ASG circuits include a gate line output terminal 22 of the first ASG circuit 20 and a gate line output terminal 23 of the second ASG circuit 21, wherein the gate line output terminal 22 of the first ASG circuit 20 is the gate line output terminal of the ASG circuit at the leftmost side in the device, and the gate line output terminal 23 of the second ASG circuit 21 is the gate line output terminal of the ASG circuit at the rightmost side in the device. The gate line output terminal of the ASG circuit at the leftmost side in the device and the gate line output terminal of the ASG circuit at the rightmost side in the device are used as the gate line output terminals of the ASG circuits to perform the real-time detection and adjustment on the signal code, and at the same time to realize the real-time detection and adjustment on the whole ASG circuit in the device.

Preferably, the level conversion module comprises a first level conversion module and a second level conversion module, wherein the first level conversion module is configured to reduce the level signal outputted by the gate line output terminal of the first ASG circuit, and the second level conversion module is configured to reduce the level signal outputted by the gate line output terminal of the second ASG circuit.

Figure 5:
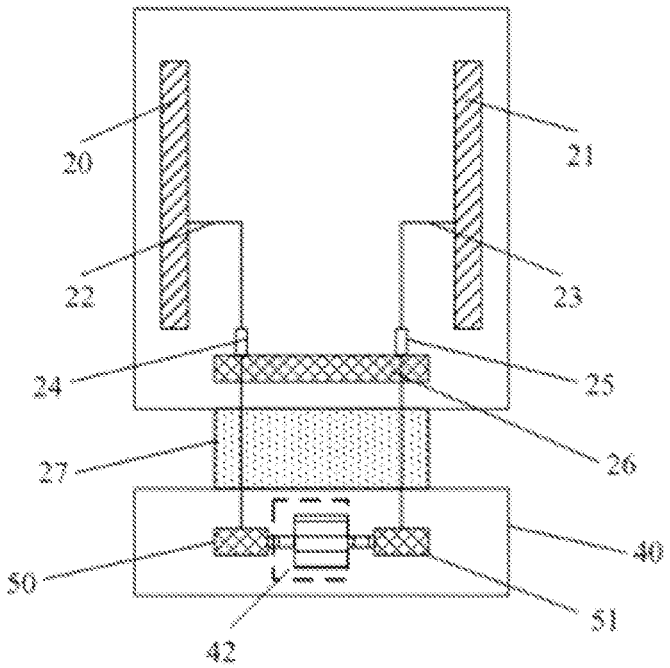

Specifically, as shown in FIG. 5, the level conversion module comprises a first level conversion module 50 and a second level conversion module 51, wherein the first level conversion module 50 is configured to reduce the level signal outputted by the gate line output terminal 22 of the first ASG circuit 20, and the second level conversion module 51 is configured to reduce the level signal outputted by the gate line output terminal 23 of the second ASG circuit 21. In this way, due to the influence of actual production process conditions, the level signal outputted by the gate line output terminal of the first ASG circuit and the level signal outputted by the gate line output terminal of the second ASG circuit are asymmetric, so the level signal outputted by the gate line output terminal of the first ASG circuit is adjusted by the first level conversion module, and the level signal outputted by the gate line output terminal of the second ASG circuit is adjusted by the second level conversion module, respectively, so that the signal code of the ASG circuits in the device can be better obtained.

Preferably, the master chip I/O port logical control unit comprises a first master chip I/O port logical control unit and a second master chip I/O port logical control unit, wherein the first master chip I/O port logical control unit is connected with the first level conversion module, and configured to receive the level signal outputted by the first level conversion module, to determine the duration time in which the level signal outputted by the gate line output terminal of the first ASG circuit exceeds the preset level signal threshold value, and to adjust the signal code required for operation of the ASG circuit and then to send the adjusted signal code to the driver integrated circuit when the duration time is less than the preset time threshold value; and the second master chip I/O port logical control unit is connected with the second level conversion module, and configured to receive the level signal outputted by the second level conversion module, to determine the duration time in which the level signal outputted by the gate line output terminal of the second ASG circuit exceeds the preset level signal threshold value, and to adjust the signal code required for operation of the ASG circuit and then to send the adjusted signal code to the driver integrated circuit when the duration time is less than the preset time threshold value.

Figure 6:
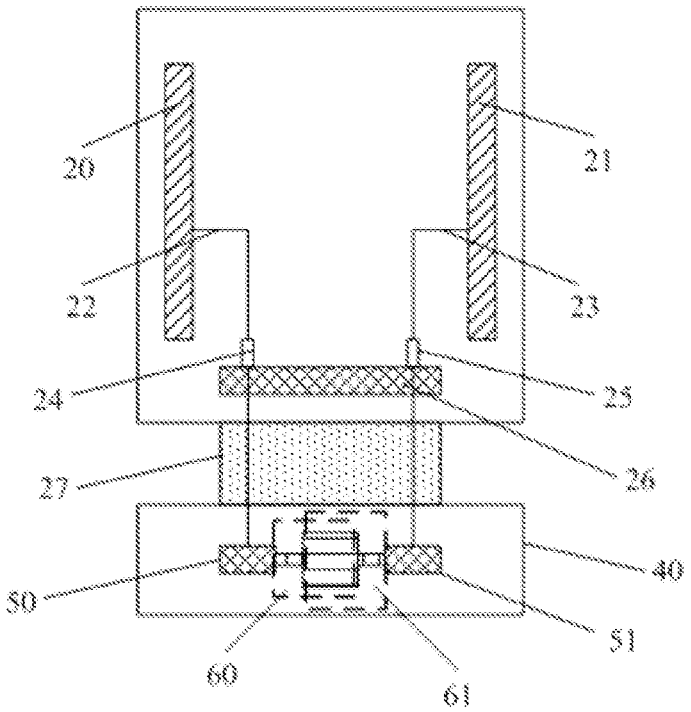

Specifically, as shown in FIG. 6, the master chip I/O port logical control unit comprises a first master chip I/O port logical control unit 60 and a second master chip I/O port logical control unit 61, wherein the first master chip I/O port logical control unit 60 is connected with the first level conversion module 50, and configured to receive the level signal outputted by the first level conversion module 50, to determine the duration time in which the level signal outputted by the gate line output terminal 22 of the first ASG circuit 20 exceeds the preset level signal threshold value, and to adjust the signal code required for operation of the ASG circuit and then to send the adjusted signal code to the driver integrated circuit 26 when the duration time is less than the preset time threshold value; and the second master chip I/O port logical control unit 61 is connected with the second level conversion module 51, and configured to receive the level signal outputted by the second level conversion module 51, to determine the duration time in which the level signal outputted by the gate line output terminal 23 of the second ASG circuit 21 exceeds the preset level signal threshold value, and to adjust the signal code required for operation of the ASG circuit and then to send the adjusted signal code to the driver integrated circuit 26 when the duration time is less than the preset time threshold value. The first master chip I/O port logical control unit and the second master chip I/O port logical control unit are set corresponding to the first level conversion module and the second level conversion module, so that the signal code required for operation of the ASG circuits can be conveniently adjusted.

Preferably, the first level conversion module comprises a first transistor, a high-voltage level input terminal and a ground point, where the first transistor is connected between the high-voltage level input terminal and the ground point, and configured to reduce the level signal outputted by the gate line output terminal of the first ASG circuit.

Preferably, the first transistor is an MOS transistor.

Preferably, the first level conversion module further comprises a first current-limiting resistor, where the first current-limiting resistor is connected between the high-voltage level input terminal and the first transistor.

Figure 7:
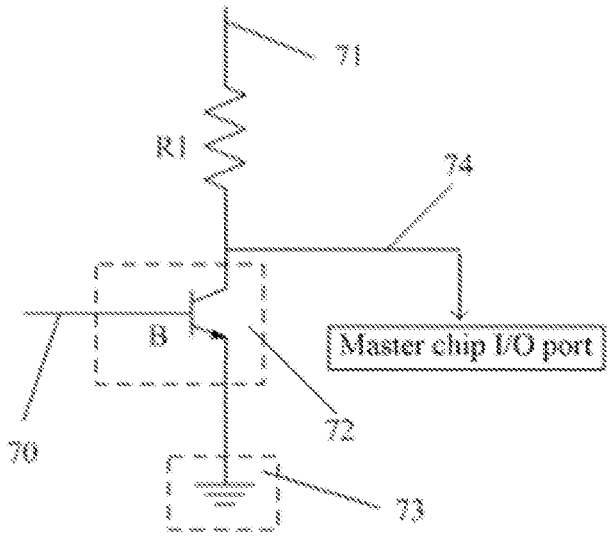
FIG. 7 is a structural schematic diagram of a first level conversion module inside a client system in a liquid crystal display device according to an embodiment of the present invention.

Specifically, as shown in FIG. 7, the first level conversion module comprises a first transistor 72, a high-voltage level input terminal 71 and a ground point 73. Preferably, the first transistor 72 is an MOS transistor, and when a voltage of a point B of the MOS transistor reaches the voltage value A, the MOS transistor is turned on. The first transistor 72 is connected between the high-voltage level input terminal 71 and the ground point 73, and configured to reduce the level signal outputted by the gate line output terminal of the first ASG circuit, wherein the level signal outputted by the gate line output terminal of the first ASG circuit is inputted to the first level conversion module via an input terminal 70 of the first level conversion module, and the first level conversion module is connected to the master chip I/O port via an output terminal 74 of the first level conversion module, so as to achieve a control effect, wherein the voltage inputted to the high-voltage level input terminal 71 is 3.3 V and equals to the high-level voltage of the I/O port.

In FIG. 7, the level conversion process of the first level conversion module according to a particular embodiment of the present invention is as follows: when the level signal outputted by the gate line output terminal of the first ASG circuit is at the high level, the output of the output terminal 74 of the first level conversion module is at the low level; when the level signal outputted by the gate line output terminal of the first ASG circuit is at the low level, the output of the output terminal 74 of the first level conversion module is at the high level; and when the gate line output terminal of the first ASG circuit has no output, the output of the output terminal 74 of the first level conversion module is continuously at the high level. In addition, in order to prevent burnout of the first level conversion module due to a too high current, the first level conversion module is further provided with a first current-limiting resistor R1, where the first current-limiting resistor R1 is connected between the high-voltage level input terminal 71 and the first transistor 72. In this way, the first level conversion module reduces the level signal outputted by the gate line output terminal of the first ASG circuit, and can reduce the loss of power consumption without affecting the normal operation of the first ASG circuit.

Preferably, the second level conversion module comprises a second transistor, a high-voltage level input terminal and a ground point, where the second transistor is connected between the high-voltage level input terminal and the ground point, and configured to reduce the level signal outputted by the gate line output terminal of the second ASG circuit.

Preferably, the second level conversion module further comprises a second current-limiting resistor, where the second current-limiting resistor is connected between the high-voltage level input terminal and the second transistor.

In addition, the second level conversion module is the same as the first level conversion module, except that the second level conversion module is configured to reduce the level signal outputted by the gate line output terminal of the second ASG circuit, and it will not be repeated herein.

Obviously, those skilled in the art can make various modifications and variations to the invention without departing from the spirit and scope of the invention. Thus the invention is also intended to encompass these modifications and variations thereto so long as these modifications and variations come into the scope of the claims appended to the invention and their equivalents.

What is claimed is:

1. A liquid crystal display device, comprising:

gate drive ASG circuits; and a driver integrated circuit, configured to connect wires from gate line output terminals of the ASG circuits with a client system;

wherein the ASG circuits output level signals to the client system, wherein the client system is configured to determine a duration time during which the level signals from the ASG circuits exceed a preset level signal threshold value, and in response to the duration time being less than the preset time threshold value, the driver integrated circuit receives an adjusted signal code required for operation of the ASG circuits, and wherein the driver integrated circuit drives the ASG circuits according to the adjusted signal code required for operation of the ASG circuits.

2. The device according to claim 1, wherein the client system is configured to:

receive the level signals from the gate line output terminals of the ASG circuits, determine the duration time in which the level signals outputted by the gate line output terminals of the ASG circuits exceed the preset level signal threshold value, adjust the signal code required for operation of the ASG circuits, and send the adjusted signal code to the driver integrated circuit in response to the duration time being less than the preset time threshold value, wherein the client system compares the duration time during which the level signals from the ASG circuits exceed the preset level signal threshold value with the preset time threshold value, and in response to the duration time being less than the preset time threshold value, the client system adjusts duty cycles of clock signals CK and CKB, wherein the clock signals CK and CKB belong to the signal code required for operation of the ASG circuits, or adjusts values of a highest voltage VGH and a lowest voltage VGL, wherein the highest voltage VGH and the lowest voltage VGL belong to the signal code required for operation of the ASG circuits, and the client system sends the adjusted signal code required for operation of the ASG circuits to the driver integrated circuit, so that the time during which the level signals from the ASG circuits exceed the preset level signal threshold value is greater than or equal to the preset time threshold value.

3. The device according to claim 1, wherein the client system comprises:

a level conversion module and a master chip I/O port logical control unit, wherein the level conversion module is configured to receive and to reduce the level signals from the ASG circuits, and to input the reduced level signals to a master chip I/O port logical control unit, and wherein the master chip I/O port logical control unit is configured to receive the reduced level signals, to determine the duration time during which the level signals from the gate line output terminals of the ASG circuits exceed the preset level signal threshold value, to adjust a signal code required for operation of the ASG circuits, and then to send the adjusted signal code to the driver integrated circuit in response to the duration time being less than the preset time threshold value.

4. The device according to claim 3, wherein the gate line output terminals of the ASG circuits include a gate line output terminal of a first ASG circuit and a gate line output terminal of a second ASG circuit, wherein the gate line output terminal of the first ASG circuit is a gate line output terminal of an ASG circuit at the leftmost side in the device, and the gate line output terminal of the second ASG circuit is a gate line output terminal of an ASG circuit at the rightmost side in the device.

5. The device according to claim 4, wherein the level conversion module comprises a first level conversion module and a second level conversion module, wherein the first level conversion module is configured to reduce a level signal from the gate line output terminal of the first ASG circuit, and the second level conversion module is configured to reduce a level signal from the gate line output terminal of the second ASG circuit.

6. The device according to claim 5, wherein the master chip I/O port logical control unit comprises a first master chip I/O port logical control unit and a second master chip I/O port logical control unit, wherein the first master chip I/O port logical control unit is connected with the first level conversion module, and configured to receive a level signal from the first level conversion module and to determine a duration time during which the level signal from the gate line output terminal of the first ASG circuit exceeds the preset level signal threshold value, to adjust the signal code required for operation of the ASG circuit, and then to send the adjusted signal code to the driver integrated circuit in response to the duration time being less than the preset time threshold value, and wherein the second master chip I/O port logical control unit is connected with the second level conversion module, and is configured to receive a level signal from the second level conversion module, to determine a duration time during which the level signal from the gate line output terminal of the second ASG circuit exceeds the preset level signal threshold value, to adjust the signal code required for operation of the ASG circuit, and then to send the adjusted signal code to the driver integrated circuit in response to the duration time being less than the preset time threshold value.

7. The device according to claim 5, wherein the first level conversion module comprises a first transistor, a high-voltage level input terminal, and a ground point, wherein the first transistor is connected between the high-voltage level input terminal and the ground point, and is configured to reduce the level signal outputted by the gate line output terminal of the first ASG circuit.

8. The device according to claim 7, wherein the first transistor is an MOS transistor.

9. The device according to claim 7, wherein the first level conversion module further comprises a first current-limiting resistor, wherein the first current-limiting resistor is connected between the high-voltage level input terminal and the first transistor.

10. The device according to claim 5, wherein the second level conversion module comprises a second transistor, a high-voltage level input terminal and a ground point, wherein the second transistor is connected between the high-voltage level input terminal and the ground point, and configured to reduce the level signal outputted by the gate line output terminal of the second ASG circuit.

11. The device according to claim 10, wherein the second level conversion module further comprises a second current-limiting resistor, wherein the second current-limiting resistor is connected between the high-voltage level input terminal and the second transistor.

* * * * *